US009382485B2

(12) United States Patent
Choi et al.

(10) Patent No.: US 9,382,485 B2
(45) Date of Patent: Jul. 5, 2016

(54) PETROLEUM UPGRADING PROCESS

(75) Inventors: Ki-Hyouk Choi, Dhahran (SA); Ashok K. Punetha, Dhahran (SA); Mohammed Rashid Al-Dossary, Al-Khobar (SA); Sameer Ali Ghamdi, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 1393 days.

(21) Appl. No.: 12/881,807

(22) Filed: Sep. 14, 2010

(65) Prior Publication Data

US 2012/0061294 A1 Mar. 15, 2012

(51) Int. Cl.

| | |
|---|---|
| ***C10G 9/00*** | (2006.01) |
| ***C10G 47/32*** | (2006.01) |
| ***C10G 65/12*** | (2006.01) |

(52) U.S. Cl.

CPC ..... *C10G 47/32* (2013.01); *C10G 65/12* (2013.01); *C10G 2300/107* (2013.01); *C10G 2300/1033* (2013.01); *C10G 2300/1074* (2013.01); *C10G 2300/1077* (2013.01); *C10G 2300/202* (2013.01); *C10G 2300/4006* (2013.01); *C10G 2300/4012* (2013.01); *C10G 2300/805* (2013.01)

(58) Field of Classification Search

None

See application file for complete search history.

(56) References Cited

U.S. PATENT DOCUMENTS

| | | | | |
|---|---|---|---|---|
| 2,623,596 | A | | 12/1952 | Whorton et al. |
| 3,112,257 | A | * | 11/1963 | Douwes et al. ..... 208/216 R |
| 3,948,754 | A | | 4/1976 | McCollum et al. |
| 3,948,755 | A | | 4/1976 | McCollum et al. |
| 3,960,706 | A | * | 6/1976 | McCollum et al. ..... 208/112 |
| 3,983,027 | A | | 9/1976 | McCollum et al. |
| 3,989,618 | A | | 11/1976 | McCollum et al. |
| 4,005,005 | A | | 1/1977 | McCollum et al. |
| 4,118,797 | A | | 10/1978 | Tarpley, Jr. |
| 4,243,514 | A | | 1/1981 | Bartholic |
| 4,443,325 | A | | 4/1984 | Chen et al. |
| 4,446,012 | A | | 5/1984 | Murthy et al. |
| 4,448,251 | A | | 5/1984 | Stine |
| 4,483,761 | A | | 11/1984 | Paspek, Jr. |
| 4,529,037 | A | | 7/1985 | Froning et al. |
| 4,543,177 | A | | 9/1985 | Murthy et al. |
| 4,543,190 | A | | 9/1985 | Modell |
| 4,550,198 | A | | 10/1985 | Myerson |
| 4,684,372 | A | | 8/1987 | Hayes et al. |
| 4,733,724 | A | | 3/1988 | Cardenas |
| 4,753,666 | A | | 6/1988 | Pastor et al. |
| 4,813,370 | A | | 3/1989 | Capamaggio |
| 4,818,370 | A | | 4/1989 | Gregoli et al. |
| 4,840,725 | A | | 6/1989 | Paspek |
| 4,951,561 | A | | 8/1990 | Moorman et al. |
| 5,096,567 | A | | 3/1992 | Paspek, Jr. et al. |
| 5,110,443 | A | | 5/1992 | Gregoli et al. |
| 5,316,659 | A | | 5/1994 | Brons et al. |
| 5,466,365 | A | | 11/1995 | Savastano et al. |
| 5,496,464 | A | | 3/1996 | Piskorz et al. |
| 5,674,405 | A | | 10/1997 | Bourhis et al. |
| 5,725,054 | A | | 3/1998 | Shayegi et al. |
| 5,778,977 | A | | 7/1998 | Bowzer et al. |
| 5,851,381 | A | | 12/1998 | Tanaka et al. |
| 5,885,440 | A | | 3/1999 | Hoehn et al. |
| 5,914,031 | A | | 6/1999 | Sentagnes et al. |
| 6,280,408 | B1 | | 8/2001 | Sipin |
| 6,325,921 | B1 | | 12/2001 | Andersen |
| 6,328,104 | B1 | | 12/2001 | Graue |
| 6,475,396 | B1 | | 11/2002 | Wofford, III et al. |
| 6,489,263 | B2 | | 12/2002 | Murray et al. |
| 6,709,601 | B2 | | 3/2004 | Wofford, III et al. |
| 6,764,213 | B2 | | 7/2004 | Shechter |
| 6,878,290 | B2 | | 4/2005 | Joussot-Dubien et al. |
| 7,144,498 | B2 | | 12/2006 | McCall et al. |
| 7,740,065 | B2 | | 6/2010 | Choi |
| 8,025,790 | B2 | | 9/2011 | Choi et al. |
| 2002/0046838 | A1 | | 4/2002 | Karanikas et al. |
| 2003/0168381 | A1 | | 9/2003 | Hokari et al. |
| 2005/0167333 | A1 | | 8/2005 | McCall et al. |
| 2006/0011511 | A1 | | 1/2006 | Hokari et al. |
| 2006/0042999 | A1 | | 3/2006 | Iqbal et al. |

(Continued)

FOREIGN PATENT DOCUMENTS

| | | |
|---|---|---|
| EP | 0199555 A2 | 10/1986 |
| EP | 423950 | 4/1991 |

(Continued)

OTHER PUBLICATIONS

Seid Mahdi Jafari et al., "Production of sub-micron emulsions by ultrasound and microfluidization techniques;" Journal of Food Engineering, vol. 82. Science Direct, 2007, pp. 478-488, Elsevier Ltd.

Jiunn-Ren Lin et al., "An Upgrading Process Through Cavitation and Surfactant," Energy & Fuels 1993, vol. 7, pp. 111-118, American Chemical Society.

B. Abismail et al., "Emulsification by ultrasound: drop size distribution and stability," Ultrasonics Sonochemistry, vol. 6, 1999, pp. 75-83, Elsevier Science B.V.

T.S.H. Leong et al., "Minimising oil droplet size using ultrasonic emulsification," Ultrasonics Sonochemistry vol. 16, 2009, pp. 721-727, Elsevier B.V.

S. Kentish et al., "The use of ultrasonics for nanoemulsion preparation," Innovative Food Science and Emerging Technologies, vol. 9, 2008, pp. 170-175, Elsevier Ltd.

Zhao et al., "Experimental Study on Vacuum Residuum Upgrading through Pyrolysis in Supercritical Water," published on Energy & Fuels, vol. 20, pp. 2067-2071, (2006).

(Continued)

*Primary Examiner* — Randy Boyer

(74) *Attorney, Agent, or Firm* — Bracewell LLP; Constance Gall Rhebergen

(57) ABSTRACT

A method and apparatus for upgrading a petroleum feedstock with supercritical water are provided. The method includes the steps of: (1) heating and pressurizing a petroleum feedstock; (2) heating and pressurizing a water feed to above the supercritical point of water; (3) combining the heated and pressurized petroleum feedstock and the heated and pressurized water feed to produce a combined feed; (4) supplying the combined feed to a hydrothermal reactor to produce a first product stream; (5) supplying the first product stream to a post-treatment process unit to produce a second product stream; and (6) separating the second product stream into a treated and upgraded petroleum stream and a water stream.

21 Claims, 2 Drawing Sheets

(56) References Cited

U.S. PATENT DOCUMENTS

| | | | | |
|---|---|---|---|---|
| 2006/0157339 | A1 | 7/2006 | Cullen | |
| 2006/0231455 | A1 | 10/2006 | Olsvik et al. | |
| 2007/0056881 | A1 | 3/2007 | Berkowitz et al. | |
| 2007/0090021 | A1 | 4/2007 | McCall et al. | |
| 2007/0140935 | A1 | 6/2007 | Hazlebeck | |
| 2007/0289898 | A1 | 12/2007 | Banerjee | |
| 2008/0066918 | A1 | 3/2008 | Smith | |
| 2008/0073292 | A1 | 3/2008 | Stenmark et al. | |
| 2008/0099373 | A1 | 5/2008 | Hokari et al. | |
| 2008/0099374 | A1 | 5/2008 | He et al. | |
| 2008/0099376 | A1 | 5/2008 | He et al. | |
| 2008/0099377 | A1 | 5/2008 | He et al. | |
| 2008/0099378 | A1 | 5/2008 | He et al. | |
| 2008/0121565 | A1 | 5/2008 | Yoo et al. | |
| 2008/0149533 | A1 | 6/2008 | Yoo et al. | |
| 2008/0264873 | A1 | 10/2008 | Gidner | |
| 2009/0145805 | A1 | 6/2009 | Choi | |
| 2009/0173664 | A1 * | 7/2009 | Choi et al. | 208/85 |
| 2009/0178952 | A1 | 7/2009 | Choi et al. | |
| 2011/0147266 | A1 | 6/2011 | Choi | |

FOREIGN PATENT DOCUMENTS

| | | |
|---|---|---|
| EP | 1342771 | 9/2003 |
| EP | 1505141 | 2/2005 |
| EP | 1537912 A1 | 6/2005 |
| EP | 1616931 | 1/2006 |
| EP | 1826527 | 8/2007 |
| JP | 2000-104311 | 9/1998 |
| JP | 2000-109850 | 10/1998 |
| JP | 2000-282063 | 10/2000 |
| JP | 2001-192676 | 7/2001 |
| JP | 2003-049180 | 2/2003 |
| JP | 2003/277770 | 10/2003 |
| JP | 2006-104311 | 4/2006 |
| WO | WO 2005-007776 | 1/2005 |
| WO | WO 2008-085436 | 7/2008 |

OTHER PUBLICATIONS

M.A. Mchugh & V.J. Krukonis, "Supercritical Fluid Extraction," 2nd ed., Butterworth-Heinemann, (1994), pp. 339-416.

Ancheyta, Jorge; Petroleum Refining; Modeling and Simulation of Catalytic Reactors for Petroleum Refining, First Edition; 2011; pp. 1-52; John Wiley & Sons, Inc.

PCT International Search Report dated Jan. 3, 2011, International Application No. PCT/US2010/060728.

Sato, Takafumi et al., "Upgrading of Asphalt With and Without Partial Oxidation in Supercritical Water," Fuel 82 (2003) pp. 1231-1239, Elsevier.

Adschiri et al. "Hydrogenation through Partial Oxidation of Hydrocarbon in Supercritical Water", published on Int. J. of The Soc. of Mat. Eng. for Resources, vol. 7, No. 2, pp. 273-281, (1999).

Adschiri et al. "Catalytic Hydrodesulfurization of Dibenzothiophene through Partial Oxidation and a Water-Gas Shift Reaction in Supercritical Water", published on Ind. Eng. Chem. Res., vol. 37, pp. 2634-2638, (1998).

Amestica, L.A. and Wolf, E.E., Catalytic Liquefaction of Coal With Supercritical Water/CO/Solvent Media, XP-002663069, Fuel, Sep. 30, 1986, pp. 1226-1332, vol. 65, Butterworth & Co. (1986).

Robinson, P.R. and Kraus, L.S., Thermochemistry of Coking in Hydroprocessing Units: Modeling Competitive Naphthalene Saturation and Condensation Reactions, XP-002663070, Apr. 26, 2006, Retrieved from Internet.

PCT International Search Report dated Nov. 21, 2011, International Application No. PCT/US2011/051192, International Filing Date: Sep. 12, 2011.

International Search Report and Written Opinion issued in PCT/US2011/051183, dated Nov. 23, 2011 (10 pages).

R.J. Parker et al.: "Liquefaction of Black Thunder Coal with Counterflow Reactor Technology", Ninth Pittsburgh Coal Conference Oct. 1992, Oct. 31, 1992, pp. 1191-1195.

Department of Trade of Industry of the United Kingdom: "Technology Status Report—Coal Liquefaction", Cleaner Coal Technology Programme, Oct. 31, 1999, pp. 1-14.

* cited by examiner

PETROLEUM UPGRADING PROCESS

FIELD OF THE INVENTION

The invention relates to a method and apparatus for upgrading petroleum products. More particularly, the present invention, as described herein, relates to a method and apparatus the upgrading of petroleum products by treatment with supercritical water.

BACKGROUND OF THE INVENTION

Petroleum is an indispensable source for energy and chemicals. At the same time, petroleum and petroleum based products are also a major source for air and water pollution. To address growing concerns with pollution caused by petroleum and petroleum based products, many countries have implemented strict regulations on petroleum products, particularly on petroleum refining operations and the allowable concentrations of specific pollutants in fuels, such as, sulfur content in gasoline fuels. For example, motor gasoline fuel is regulated in the United States to have a maximum total sulfur content of less than 10 ppm sulfur.

As noted above, due to its importance in our everyday lives, demand for petroleum is constantly increasing and regulations imposed on petroleum and petroleum based products are becoming stricter. The available petroleum sources currently being refined and used throughout the world, such as, crude oil and coal, contain much higher quantities of impurities (for example, elemental sulfur and compounds containing sulfur, nitrogen and metals). Additionally, current petroleum sources typically include large amounts of heavy hydrocarbon molecules, which must then be converted to lighter hydrocarbon molecules through expensive processes like hydrocracking for eventual use as a transportation fuel.

Current conventional techniques for petroleum upgrading include hydrogenative methods using hydrogen in the presence of a catalyst, in methods such as hydrotreating and hydrocracking. Thermal methods performed in the absence of hydrogen are also known, such as coking and visbreaking.

Conventional methods for petroleum upgrading suffer from various limitations and drawbacks. For example, hydrogenative methods typically require large amount of hydrogen gas from an external source to attain desired upgrading and conversion. These methods also typically suffer from premature or rapid deactivation of catalyst, as is typically seen with heavy feedstock and/or harsh conditions, thus requiring the regeneration of the catalyst and/or addition of new catalyst, thus leading to process unit downtime. Thermal methods frequently suffer from the production of large amounts of coke as a byproduct and the limited ability to remove impurities, such as, sulfur and nitrogen. This in turn results in the production of large amount of olefins and diolefins, which may require stabilization. Additionally, thermal methods require specialized equipment suitable for severe conditions (high temperature and high pressure), require an external hydrogen source, and require the input of significant energy, thereby resulting in increased complexity and cost.

SUMMARY

The current invention provides a method and device for upgrading a hydrocarbon containing petroleum feedstock.

In one aspect, a process for upgrading of petroleum feedstock is provided. The process includes the step of providing a pressurized and heated petroleum feedstock. The petroleum feedstock is provided at a temperature of between about 10° C. and 250° C. and a pressure of at least about 22.06 MPa. The process also includes the step of providing a pressurized and heated water feed. The water is provided at a temperature of between about 250° C. and 650° C. and a pressure of at least about 22.06 MPa. The pressurized and heated petroleum feedstock and the pressurized and heated water feed are combined to form a combined petroleum and water feed stream. The combined petroleum and water feed stream is supplied to a hydrothermal reactor to produce a first product stream. The reactor is maintained at a temperature of between about 380° C. and 550° C. and the residence time of the combined petroleum and water stream in the reactor is between about 1 second and 120 minutes. After treatment in the reactor, the first product stream is transferred to a post-treatment process. The post-treatment process is maintained at a temperature of between about 50° C. and 350° C. and the first product stream has a residence time in said post treatment process of between about 1 minute and 90 minutes. A second product stream is collected from the post-treatment process, the second product stream having at least one of the following characteristics: (1) a higher concentration of light hydrocarbons relative to the concentration of light hydrocarbons in the first product stream and/or (2) a decreased concentration of either sulfur, nitrogen and/or metals relative to the concentration of sulfur, nitrogen and/or metals in the first product stream.

In another aspect, a method for the upgrading of a petroleum feed utilizing supercritical water is provided. The process includes the steps of (1) heating and pressurizing the petroleum feedstock; (2) heating and pressurizing a water feed to the supercritical condition; (3) combining the heated and pressurized petroleum feedstock and the supercritical water feed to produce the combined feed; (4) supplying the combined petroleum and supercritical water feed to the hydrothermal reactor to produce the first product stream; (5) supplying the first product stream to the post-treatment process unit to produce the second product stream; and (6) separating the second product stream into an upgraded petroleum stream and a water stream.

In certain embodiments, the water is heated to a temperature greater than about 374° C. and a pressure of greater than about 22.06 MPa. Alternatively, the hydrothermal reactor is maintained at a temperature of greater than about 400° C. In alternate embodiments, the hydrothermal reactor is maintained at a pressure of greater than about 25 MPa. In certain embodiments, the post treatment process unit is a desulfurization unit. In yet other embodiments, the post-treatment process unit is a hydrothermal unit. Optionally, the post-treatment process unit is a tubular-type reactor. In certain embodiments, the post-treatment process unit is maintained at a temperature of between about 50° and 350° C. Optionally, the post-treatment process unit includes a post-treatment catalyst.

DETAILED DESCRIPTION OF THE INVENTION

Figure 1:
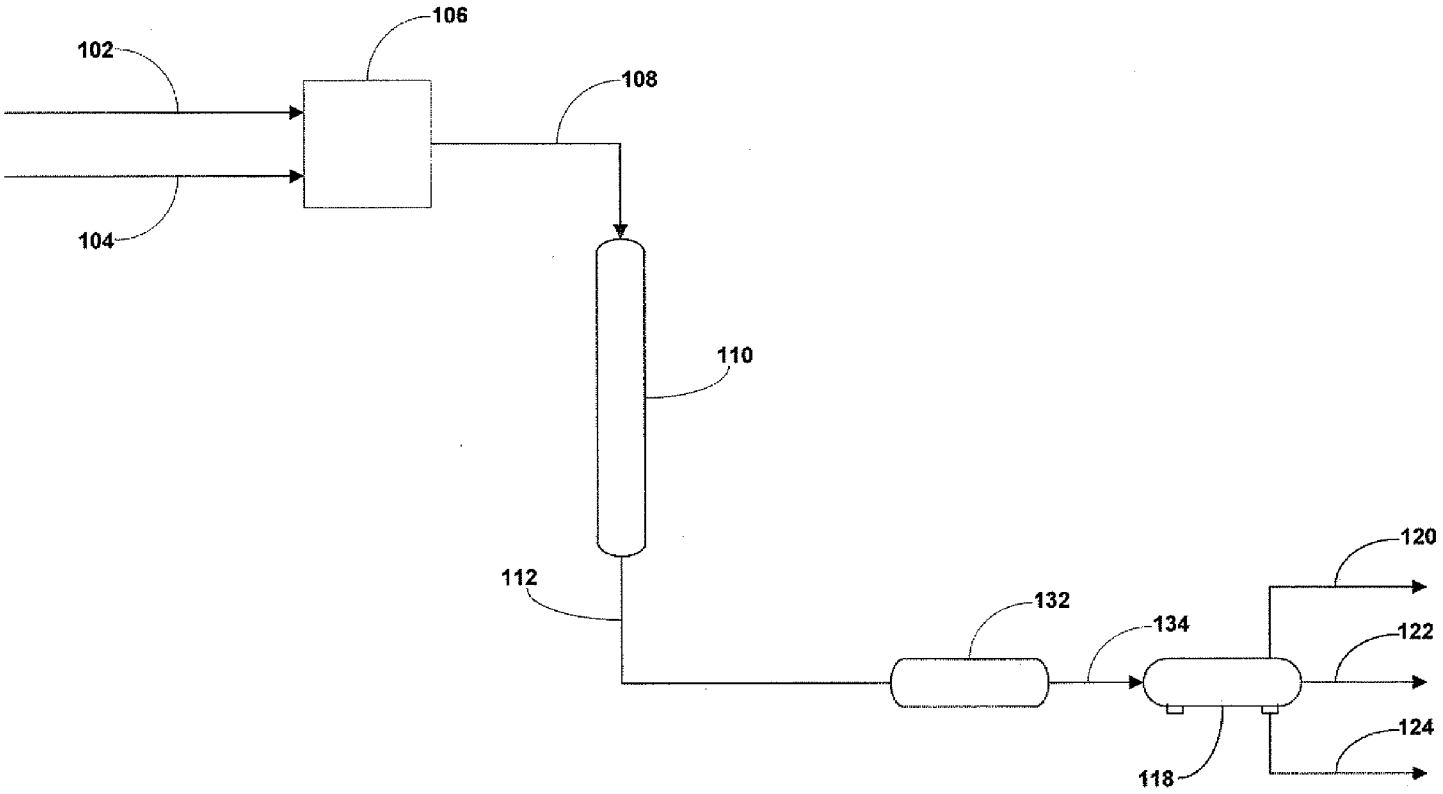
FIG. 1 is a diagram of one embodiment of a process for upgrading a petroleum feedstock according to the present invention.

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein are set forth without any loss of generality to, and without imposing limitations thereon, the claimed invention.

In one aspect, the present invention provides a method for upgrading a hydrocarbon containing petroleum feedstock. More specifically, in certain embodiments, the present invention provides a method for upgrading a petroleum feedstock utilizing supercritical water, by a process which requires no added or external source of hydrogen, has reduced coke production, and has significant removal of impurities, such as, elemental sulfur and compounds containing sulfur, nitrogen and metals. In addition, the methods described herein result in various other improvements in the petroleum product, including higher API gravity, higher middle distillate yield (as compared with the middle distillate present in the feedstock), and hydrogenation of unsaturated compounds present in the petroleum feedstock.

Hydrocracking is a chemical process wherein complex organic molecules or heavy hydrocarbons are broken down into simpler molecules (e.g., heavy hydrocarbons are broken down into light hydrocarbons) by the breaking of carbon-carbon bonds. Typically, hydrocracking processes require high temperatures and catalysts. Hydrocracking is a process wherein the breaking of bonds is assisted by an elevated pressure and added hydrogen gas, wherein, in addition to the reduction or conversion of heavy or complex hydrocarbons into lighter hydrocarbons, the added hydrogen is also operable to remove at least a portion of the sulfur and/or nitrogen present in a hydrocarbon containing petroleum feed.

In one aspect, the present invention utilizes supercritical water as a reaction medium, catalyst, and source of hydrogen to upgrade petroleum. The critical point of water is achieved at reaction conditions of approximately 374° C. and 22.06 MPa. Above those conditions, the liquid and gas phase boundary of water disappears, and the fluid has characteristics of both fluid and gaseous substances. Supercritical water is able to dissolve soluble materials like a fluid and has excellent diffusibility like a gas. Regulation of the temperature and pressure allows for continuous "tuning" of the properties of the supercritical water to be more liquid or more gas like. Supercritical water also has increased acidity, reduced density and lower polarity, as compared to sub-critical water, thereby greatly extending the possible range of chemistry which can be carried out in water. In certain embodiments, due to the variety of properties that are available by controlling the temperature and pressure, supercritical water can be used without the need for and in the absence of organic solvents.

Supercritical water has various unexpected properties, and, as it reaches supercritical boundaries and above, is quite different from subcritical water. Supercritical water has very high solubility toward organic compounds and infinite miscibility with gases. Also, near-critical water (i.e., water at a temperature and a pressure that are very near to, but do not exceed, the critical point of water) has very high dissociation constant. This means water at near-critical conditions is very acidic. This high acidity can be utilized as a catalyst for various reactions. Furthermore, radical species can be stabilized by supercritical water through the cage effect (i.e., the condition whereby one or more water molecules surrounds radicals, which prevents the radicals from interacting). Stabilization of radical species is believed to prevent inter-radical condensation and thus, reduce the amount of coke produced in the current invention. For example, coke production can result from the inter-radical condensation, such as for example, in polyethylene. In certain embodiments, supercritical water can generate hydrogen through steam reforming reaction and water-gas shift reaction, which can then be used for upgrading petroleum.

The present invention discloses a method of upgrading a petroleum feedstock. The invention includes the use of supercritical water for hydrothermal upgrading without an external supply of hydrogen and without the need for a separate externally supplied catalyst. As used herein, "upgrading" or "upgraded" petroleum or hydrocarbon refers to a petroleum or hydrocarbon product that has at least one of a higher API gravity, higher middle distillate yield, lower sulfur content, lower nitrogen content, or lower metal content, than does the petroleum or hydrocarbon feedstock.

The petroleum feedstock can include any hydrocarbon crude that includes either impurities (such as, for example, elemental sulfur, compounds containing sulfur, nitrogen and metals, and combinations thereof) and/or heavy hydrocarbons. As used herein, heavy hydrocarbons refers to hydrocarbons having a boiling point of greater than about 360° C., and can include aromatic hydrocarbons, as well as alkanes and alkenes. Generally, the petroleum feedstock can be selected from whole range crude oil, topped crude oil, product streams from oil refineries, product streams from refinery steam cracking processes, liquefied coals, liquid products recovered from oil or tar sand, bitumen, oil shale, asphaltene, hydrocarbons that originate from biomass (such as for example, biodiesel), and the like.

Referring to FIG. 1, the process includes the step of providing petroleum feedstock 102. Optionally, the process includes the step of heating and pressurizing petroleum feedstock 102 to provide a heated and pressurized petroleum feedstock. A pump (not shown) can be provided for supplying petroleum feedstock 102. In certain embodiments petroleum feedstock 102 is heated to a temperature of up to about 250° C., alternatively between about 50 and 200° C., or alternatively between about 100 and 175° C. In certain other embodiments, petroleum feedstock 102 can be provided at a temperature as low as about 10° C. Preferably, the step of heating of the petroleum feedstock is limited, and the temperature to which the petroleum feedstock is heated is maintained as low as possible. Petroleum feedstock 102 can be pressurized to a pressure of greater than atmospheric pressure, preferably at least about 15 MPa, alternatively greater than about 20 MPa, or alternatively greater than about 22 MPa.

The process also includes the step of providing water feed 104. Water feed 104 is preferably heated and pressurized to a temperature and pressure near or above the supercritical point of water (i.e., heated to a temperature near or greater than about 374° C. and pressurized to a pressure near or greater than about 22.06 MPa), to provide a heated and pressurized water feed. In certain embodiments, water feed 104 is pressurized to a pressure of between about 23 and 30 MPa, alternatively to a pressure of between about 24 and 26 MPa. Water feed 104 is heated to a temperature of greater than about 250° C., optionally between about 250 and 650° C., alternatively between about 300 and 600° C., or between about 400 and 550° C. In certain embodiments, the water is heated and pressurized to a temperature and pressure such that the water is in its supercritical state.

Figure 2:
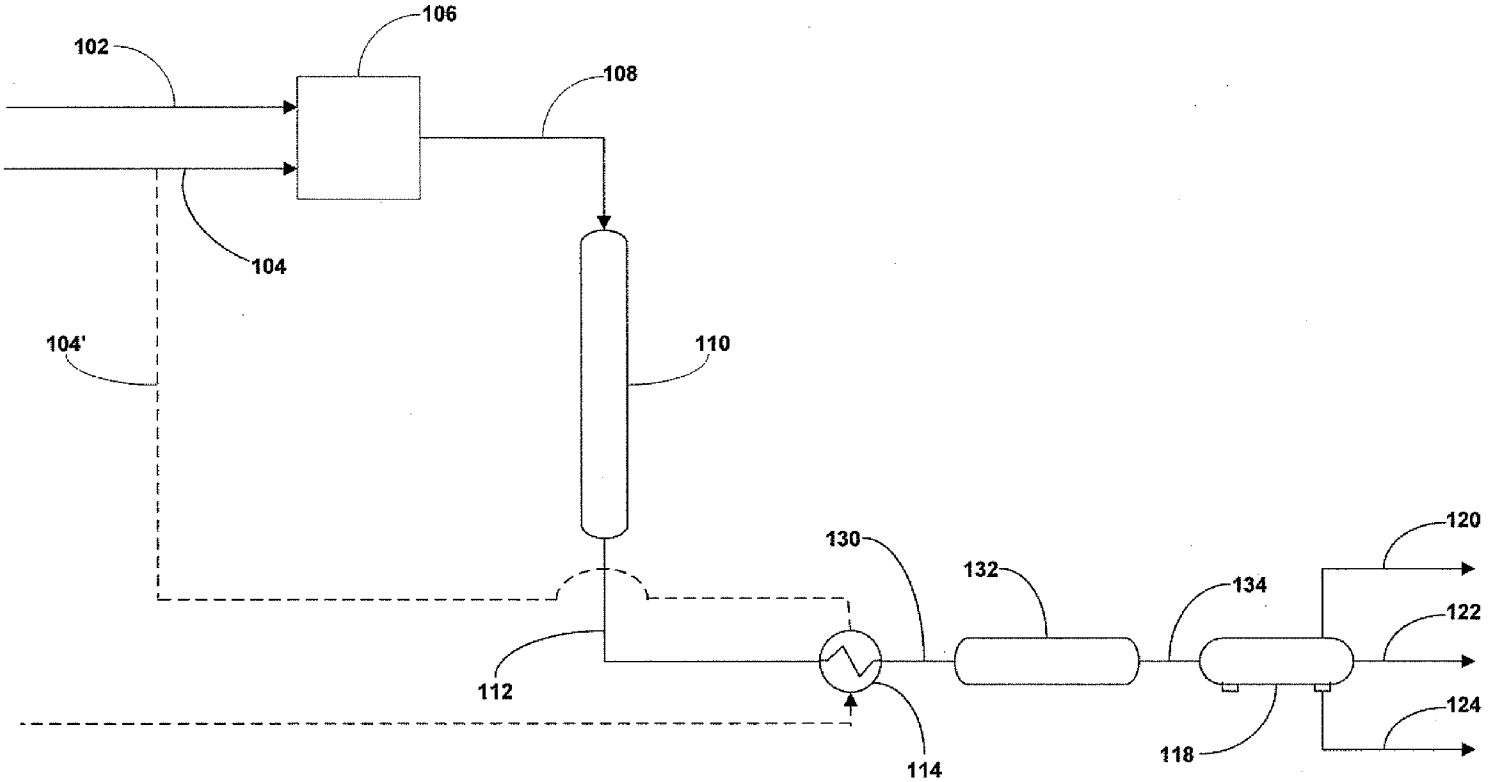
FIG. 2 is a diagram of another embodiment of a process for upgrading a petroleum feedstock according to the present invention.

Petroleum feedstock 102 and water feed 104 can be heated using known means, including but not limited to, strip heaters, immersion heaters, tubular furnaces, heat exchangers, and like devices. Typically, the petroleum feedstock and water feed are heated utilizing separate heating devices, although it is understood that a single heater can be employed to heat both feedstreams. In certain embodiments, as shown in FIG. 2, water feed 104 is heated with heat exchanger 114. The volumetric ratio of petroleum feedstock 102 and water feed 104 can be between about 1:10 and 10:1, optionally between about 1:5 and 5:1, or optionally between about 1:2 and 2:1.

Petroleum feedstock 102 and water feed 104 are supplied to means for mixing 106 the petroleum and water feeds to produce a combined petroleum and water feed stream 108, wherein water feed is supplied at a temperature and pressure near or greater than the supercritical point of water. Petroleum feedstock 102 and water feed 104 can be combined by known means, such as for example, a valve, tee fitting or the like. Optionally, petroleum feedstock 102 and water feed 104 can be combined in a larger holding vessel that is maintained at a temperature and pressure above the supercritical point of water. Optionally, the petroleum feedstock 102 and water feed 104 can be supplied to a larger vessel that includes mixing means, such as a mechanical stirrer, or the like. In certain preferred embodiments, petroleum feedstock 102 and water feed 104 are thoroughly mixed at the point where they are combined. Optionally, the mixing means or holding vessel can include means for maintaining an elevated pressure and/or means for heating the combined petroleum and water stream.

The heated and pressurized combined petroleum and water feed stream 108 is injected through a transport line to a hydrothermal reactor 110. The transport line can be any known means for supplying a feed steam operable to maintain a temperature and pressure above at least the supercritical point of water, such as for example, a tube or nozzle. The transport lines can be insulated or can optionally include a heat exchanger. Preferably, the transport line is configured to operate at pressure greater than 15 MPa, preferably greater than 20 MPa. The transport line can be horizontal or vertical, depending upon the configuration of the hydrothermal reactor 110. The residence time of the heated and pressurized reaction feed 108 in the transport line can be between about 0.1 seconds and 10 minutes, optionally between about 0.3 seconds and 5 minutes, or optionally between about 0.5 seconds and 1 minute.

Hydrothermal reactor 110 can be a known type of reactor, such as, a tubular type reactor, vessel type reactor, optionally equipped with stirrer, or the like, which is constructed from materials that are suitable for the high temperature and high pressure applications required in the present invention. Hydrothermal reactor 110 can be horizontal, vertical or a combined reactor having horizontal and vertical reaction zones. Hydrothermal reactor 110 preferably does not include a solid catalyst. The temperature of hydrothermal reactor 110 can be maintained between about 380 to 550° C., optionally between about 390 to 500° C., or optionally between about 400 to 450° C. Hydrothermal reactor 110 can include one or more heating devices, such as for example, a strip heater, immersion heater, tubular furnace, or the like, as known in the art. The residence time of heated and pressurized combined feed stream in the hydrothermal reactor 110 can be between about 1 second to 120 minutes, optionally between about 1 minutes to 60 minutes, or optionally between about 2 minutes to 30 minutes.

The reaction of the supercritical water and petroleum feed (i.e., the combined petroleum and water feed steam) is operable to accomplish at least one of: cracking, isomerizing, alkylating, hydrogenating, dehydrogenating, disporportionating, dimerizing and/or oligomerizing, of the petroleum feed by thermal reaction. Without being bound by theory, it is believed that the supercritical water functions to steam reform hydrocarbons, thereby producing hydrogen, carbon monoxide, carbon dioxide hydrocarbons, and water. This process is a major source of hydrogen in the reactor, thereby eliminating the need to supply external hydrogen. Thus, in a preferred embodiment, the supercritical thermal treatment of the petroleum feed is in the absence of an external source of hydrogen and in the absence of an externally supplied catalyst. Cracking of hydrocarbons produces smaller hydrocarbon molecules, including but not limited to, methane, ethane and propane.

Hydrothermal reactor 110 produces a first product stream that includes lighter hydrocarbons than the hydrocarbons present in petroleum feedstock 102, preferably, methane, ethane and propane, as well as water. As noted previously, lighter hydrocarbons refers to hydrocarbons that have been cracked, resulting in molecules that have a lower boiling point than the heavier hydrocarbons present in the petroleum feed 102.

First product stream 112 can then be supplied to post-treatment device 132 for further processing. In certain embodiments, the post-treatment device 132 is operable to remove sulfur, including aliphatic sulfur compounds. Post-treatment device 132 can be any process that results in further cracking or purification of any hydrocarbons present in the first product stream, and the post-treatment device can be any known reactor type, such as for example, a tubular type reactor, vessel type reactor equipped with stirring means, a fixed bed, packed bed, slurry bed or fluidized bed reactor, or like device. Optionally, post-treatment device 132 can be a horizontal reactor, a vertical reactor, or reactor having both horizontal and vertical reaction zones. Optionally, post treatment device 132 includes a post-treatment catalyst.

The temperature maintained in post treatment device 132 is preferably from about 50° to 350° C., optionally between about 100° to 300° C., or optionally between about 120° to 200° C. In alternate embodiments, post treatment device 132 is maintained at a temperature and pressure that is less than the critical point of water (i.e., post-treatment device 132 is maintained at a temperature of less than about 374° C. and a pressure of less than about 22 MPa), but such that water is maintained in a liquid phase.

In certain preferred embodiments, post-treatment device 132 is operated without the need for an external heat supply. In certain embodiments, first product stream 112 is supplied directly to post-treatment device 132 without first cooling or depressurizing the stream. In certain embodiments, first product stream 112 is supplied to post-treatment device 132 without first separating the mixture. Post-treatment device 132 can include a water-resistant catalyst, which preferably deactivates relatively slowly upon exposure to water. Thus, first product stream 112 maintains sufficient heat for the reaction in post-treatment device 132 to proceed. Preferably, sufficient heat is maintained such that water is less likely to adsorb to the surface of the catalyst in post-treatment device 132.

In other embodiments, post-treatment device 132 is a reactor that includes the post-treatment catalyst and does not require an external supply of hydrogen gas. In other embodiments, post-treatment device 132 is a hydrothermal reactor that includes the post-treatment catalyst and an inlet for introducing of hydrogen gas. In alternate embodiments, post-treatment device 132 is selected from a desulfurization, denitrogenation or demetalization unit that includes the post-treatment catalyst, which is suitable for the desulfurization, denitrogenation, demetalization and/or hydroconversion of hydrocarbons present in first product stream 112. In yet other embodiments, post-treatment device 132 is a hydrodesulfurization unit that employs hydrogen gas and the post-treatment catalyst. Alternatively, in certain embodiments, post-treatment device 132 may be a reactor that does not employ the post-treatment catalyst. In certain other embodiments, post-treatment device 132 is operated without an external supply of hydrogen or other gas.

In certain embodiments, the post-treatment catalyst may be suitable for desulfurization or demetalization. In certain embodiments, the post-treatment catalyst provides active sites on which sulfur and/or nitrogen containing compounds can be transformed into compounds that do not include sulfur or nitrogen, while at the same time liberating sulfur as hydrogen sulfide and/or nitrogen as ammonia. In other embodiments wherein post-treatment device 132 is operated such that the water is at or near its supercritical state, the post-treatment catalyst can provide an active site which can trap hydrogen that is useful for breaking carbon-sulfur and carbon-nitrogen bonds, as well as for saturation of unsaturated carbon-carbon bonds, or can promote hydrogen transfer between hydrocarbon molecules.

The post-treatment catalyst can include a support material and an active species. Optionally, the post-treatment catalyst can also include a promoter and/or a modifier. In a preferred embodiment, the post-treatment catalyst support material is selected from the group consisting of aluminum oxide, silicon dioxide, titanium dioxide, magnesium oxide, yttrium oxide, lanthanum oxide, cerium oxide, zirconium oxide, activated carbon, or like materials, or combinations thereof. The post-treatment catalyst active species includes between 1 and 4 of the metals selected from the group consisting of the Group IB, Group IIB, Group IVB, Group VB, Group VIB, Group VIIB and Group VIIIB metals. In certain preferred embodiments, the post-treatment catalyst active species is selected from the group consisting of cobalt, molybdenum and nickel. Optionally, the post-treatment catalyst promoter metal is selected from between 1 and 4 of the elements selected from the group consisting of the Group IA, Group IIA, Group IIIA and Group VA elements. Exemplary post-treatment catalyst promoter elements include boron and phosphorous. Optionally, the post-treatment catalyst modifier can include between 1 and 4 elements selected from the group consisting of the Group VIA and Group VIIA elements. The overall shape of the post-treatment catalyst, including the support material and active species, as well as any optional promoter or modifier elements, are preferably pellet shaped, spherical, extrudated, flake, fabric, honeycomb or the like, and combinations thereof.

In one embodiment, the optional post-treatment catalyst can include molybdenum oxide on an activated carbon support. In one exemplary embodiment, the post-treatment catalyst can be prepared as follows. An activated carbon support having a surface area of at least 1000 $m^2/g$, preferably about 1500 $m^2/g$, is dried at a temperature of at least about 110° C. prior to use. To a 40 mL solution of ammonium heptamolybdate tetrahydrate having a concentration of about 0.033 g/mL was added approximately 40 g of the dried activated carbon, and the mixture was stirred at room temperature under atmospheric conditions. Following stirring, the sample was dried under atmospheric conditions at a temperature of about 110° C. The dried sample was then heat treated at a temperature of about 320° C. for about 3 hours under atmospheric conditions. The resulting product was analyzed and showed approximately 10% loading of $MoO_3$, and having a specific surface area of between about 500 and 1000 $m^2/g$.

In certain embodiments, the catalyst can be a commercial catalyst. In exemplary embodiments, the catalyst is a metal oxide. In certain preferred embodiments, the catalyst is not in a fully sulfided form, as is typical for many commercial hydrodesulfurization catalysts. In one preferred embodiment, the post-treatment catalyst is stable when exposed to warm or hot water (e.g., water at a temperature of greater than about 40° C.). Additionally, in certain embodiments, it is desirable that the post-treatment catalyst has a high crush strength and a high resistance to attrition as it is generally understood that the development of catalyst fines is undesirable.

Post-treatment device 132 can be configured and operated to specifically remove mercaptans, thiols, thioethers, and other organo-sulfur compounds that may form as a result of recombination reactions of hydrogen sulfide (which is released during desulfurization of the petroleum feedstock by reaction with the supercritical water) and olefins and diolefins (which is produced during cracking of the petroleum feedstock by reaction with the supercritical water), which frequently occur in the hydrothermal reactor. The removal of the newly formed sulfur compounds from the recombination reaction may be through the dissociation of carbon-sulfur bonds, with the aid of catalyst, and in certain embodiments, water (subcritical water). In embodiments wherein the post treatment device is configured to remove sulfur from first product stream 112 and post treatment device 132 is positioned subsequent to hydrothermal reactor 110, at least a portion of the lighter sulfur compounds, such as hydrogen sulfide, can be removed, thereby extending the operable lifetime of the post treatment catalyst.

In certain embodiments, no external supply of hydrogen gas to post-treatment device 132 is required. Alternatively, an external supply of hydrogen gas is supplied to post-treatment device 132. In other embodiments, hydrogen gas is produced as a side product of the production of the supercritical water and supplied to post-treatment device 132 as a component of first product stream 112. Hydrogen gas can be produced in main hydrothermal reactor by steam reforming (hydrocarbon feedstock ($C_xH_y$) reacting with water ($H_2O$) to produce carbon monoxide (CO) or carbon dioxide ($CO_2$) and hydrogen gas ($H_2$)), or by a water-gas shift reaction (wherein CO and $H_2O$ react to form $CO_2$ and $H_2$), although in certain embodiments, the amount of hydrogen gas generated may be relatively small.

In certain embodiments, first product stream 112 exiting hydrothermal reactor 110 can be separated into a water recycle stream and a hydrocarbon product stream, and the hydrocarbon product stream can then be supplied to post treatment device 132 for further processing.

The temperature in post treatment device 132 can be maintained with an insulator, heating device, heat exchanger, or combination thereof. In embodiments employing an insulator, the insulator can be selected from plastic foam, fiber glass block, fiber glass fabric and others known in the art. The heating device can be selected from strip heater, immersion heater, tubular furnace, and others known in the art. Referring to FIG. 2, in certain embodiments wherein a heat exchanger 114 is employed, the heat exchanger can be used in combination with a pressurized petroleum feedstock 102, pressurized water 104, pressurized and heated petroleum feedstock, or pressurized and heated petroleum water, such that cooled treated stream 130 is produced and supplied to post treatment device 132.

In certain embodiments, the residence time of first product stream 112 in post-treatment device 132 can be from about 1 second to 90 minutes, optionally from about 1 minutes to 60 minutes, or optionally from about 2 minutes to 30 minutes. The post-treatment device process can be operated as a steady-state process, or alternatively can be operated as a batch process. In certain embodiments wherein the post-treatment process is a batch process, two or more post-treatment devices can be employed in parallel, thereby allowing the process to run continuously. Deactivation of catalyst can be caused by strong adsorption of hydrocarbons onto the catalyst surface, loss of catalyst due to dissolution into water, sintering of active phase, or by other means. Regeneration can be achieved by combustion and the addition of lost components to the catalyst. In certain embodiments, regeneration can be achieved with supercritical water. In certain embodiments, wherein deactivation of the post-treatment catalyst is relatively quick, multiple post treatment devices can be employed to operate the process continuously (for example, one post treatment device in regeneration, one post treatment device in operation). Utilization of parallel post-treatment devices allow for the post-treatment catalyst utilized in the post-treatment device to be regenerated while the process is being operated.

Post treatment device 132 provides a second product stream 134 that can include hydrocarbons 122 and water 124. In embodiments wherein second product stream 134 includes both hydrocarbons 122 and water 124, the second product stream can be supplied to a separation unit 118 suitable for separating hydrocarbons and water to thereby produce a water steam suitable for recycle and a hydrocarbon product stream. In certain embodiments, post treatment device 132 may also produce hydrocarbon vapor stream 120, which may also be separated from water 124 and liquid hydrocarbons 122. The vapor product can include methane, ethane, ethylene, propane, propylene, carbon monoxide, hydrogen, carbon dioxide, and hydrogen sulfide. In certain embodiments, hydrocarbon product stream 134 preferably has a lower content of at least one of sulfur, sulfur containing compounds, nitrogen containing compounds, metals and metal containing compounds, which were removed by post-treatment device 132. In other embodiments, hydrocarbon product stream 122 has a greater concentration of light hydrocarbons (i.e., post-treatment device 132 is operable to crack at least a portion of the heavy hydrocarbons present in treated stream 112). In certain embodiments, it is possible for the post treatment device to crack certain unstable hydrocarbons that are present, thereby resulting in a reduction of boiling point of the hydrocarbon product stream through the increase of light fraction hydrocarbons.

In certain embodiments, prior to supplying first product stream 112 to post treatment device 132, first product stream can be supplied to cooling means 114 to produce cooled treated stream 130. Exemplary cooling devices can be selected from a chiller, heat exchanger, or other like device known in the art. In certain preferred embodiments, the cooling device can be heat exchanger 114, wherein first product stream 112 and either the petroleum feedstock, pressurized petroleum feedstock, water feed, pressurized water feed, pressurized and heated petroleum feedstock or pressurized and heated petroleum water 104' are supplied to the heat exchanger such that the treated stream is cooled and the petroleum feedstock, pressurized petroleum feedstock, water feed, pressurized water feed, pressurized, heated petroleum feedstock, or pressurized and heated petroleum water is heated. In certain embodiments, the temperature of cooled first product stream 130 is between about 5 and 150° C., optionally between about 10 and 100° C., or optionally between about 25 and 70° C. In certain embodiments, heat exchanger 114 can be used to in the heating of the feed petroleum and water streams 102 and/or 104, respectively, and the cooling of the first product stream 112.

In certain embodiments, cooled first product stream 130 can be depressurized to produce a depressurized first product stream. Exemplary devices for depressurizing the product lines can be selected from a pressure regulating valve, capillary tube, or like device, as known in the art. In certain embodiments, the depressurized first product stream can have a pressure of between about 0.1 MPa and 0.5 MPa, optionally between about 0.1 MPa to 0.2 MPa. The depressurized first product stream 134 can then be supplied to a separator 118 and separated to produce gas 120 and liquid phase streams, and the liquid phase hydrocarbon containing stream can be separated to produce a water recycle stream 124 and a hydrocarbon containing product stream 122.

In certain embodiments, post treatment device 132 can be positioned upstream of both a cooler and a depressurization device. In alternate embodiments, post treatment device 132 can be positioned downstream of a cooler and upstream of a depressurizing device.

One advantage of the present invention and the inclusion of post-treatment device 132 is that the overall size of hydrothermal reactor 110 can be reduced. This is due, in part, to the fact that removal of sulfur containing species can be achieved in post-treatment device 132, thereby reducing the residence time of the petroleum feedstock and supercritical water in hydrothermal reactor 110. Additionally, the use of post-treatment device 132 also eliminates the need to operate hydrothermal reactor 110 at temperatures and pressures that are significantly greater than the critical point of water.

Example 1

Whole range Arabian Heavy crude oil and deionized water are pressurized to a pressure of about 25 MPa utilizing separate pump. The volumetric flow rates of crude oil and water, standard conditions, are about 3.1 and 6.2 mL/minute, respectively. The crude oil and water feeds are pre-heated using separate heating elements to temperatures of about 150° C. and about 450° C., respectively, and supplied to a mixing device that includes simple tee fitting having 0.083 inch internal diameter. The combined crude oil and water feed stream is maintained at about 377° C., above critical temperature of water. The main hydrothermal reactor is vertically oriented and has an internal volume of about 200 mL. The temperature of combined crude oil and water feed stream in the reactor is maintained at about 380° C. The hydrothermal reactor product stream is cooled with a chiller to produce a cooled product stream, having a temperature of approximately 60° C. The cooled product stream is depressurized by a back pressure regulator to atmospheric pressure. The cooled product stream is separated into gas, oil and water phase products. The total liquid yield of oil and water is about 100 wt %. Table 1 shows representative properties of whole range Arabian Heavy crude oil and final product.

Example 2

Whole range Arabian Heavy crude oil and deionized water are pressurized with pumps to a pressure of about 25 MPa. The volumetric flow rates of the crude oil and water at standard condition are about 3.1 and 6.2 ml/minute, respectively. The petroleum and water streams are preheated using separate heaters, such that the crude oil has a temperature of about 150° C. and the water has a temperature of about 450° C., and are supplied to a combining device, which is a simple tee fitting having a 0.083 inch internal diameter, to produce a combined petroleum and water feed stream. The combined petroleum and water feed stream is maintained at a temperature of about 377° C., above the critical temperature of water and supplied to the main hydrothermal reactor, which has an internal volume of about 200 ml and is vertically oriented. The temperature of the combined petroleum and water feed stream in the hydrothermal reactor is maintained at about 380° C. A first product stream is removed from the hydrothermal reactor and cooled with a chiller to produce cooled first product stream, having a temperature of about 200° C., which is supplied to the post treatment device, which is a vertically oriented tubular reactor having an internal volume of about 67 mL. The temperature of post treatment device is maintained at about 100° C. Therefore, the post treatment device has temperature gradient of between 200° C. and 100° C. through the course of flow of the first product stream. Hydrogen gas is not separately supplied to the post-treatment device. The post treatment reactor includes a spherically shaped proprietary catalyst that includes molybdenum oxide and activated carbon, which can be prepared by an incipient wetting method. The post treatment device produces a second product stream that is depressurized with a back pressure regulator to atmospheric pressure. The second product stream is then separated into gas and liquid phase. Total liquid yield of oil and water is about 100 wt %. The liquid-phase of the second product stream is separated to oil and water phases using a demulsifier and centrifuge machine. Table 1 shows representative properties of post treated final product.

Example 3

Whole range Arabian Heavy crude oil and deionized water are pressurized with pumps to a pressure of about 25 MPa. The volumetric flow rates of the crude oil and water at standard condition are about 3.1 and 6.2 ml/minute, respectively. The petroleum and water streams are preheated using separate heaters, such that the crude oil has a temperature of about 150° C. and the water has a temperature of about 450° C., and are supplied to a combining device, which is a simple tee fitting having a 0.083 inch internal diameter, to produce a combined petroleum and water feed stream. The combined petroleum and water feed stream is maintained at a temperature of about 377° C., above the critical temperature of water and supplied to the main hydrothermal reactor, which has an internal volume of about 200 ml and is vertically oriented. The temperature of the combined petroleum and water feed stream in the hydrothermal reactor is maintained at about 380° C. A first product stream is removed from the hydrothermal reactor and cooled with a chiller to produce cooled first product stream, having a temperature of about 200° C., which is supplied to the post treatment device, which is a vertically oriented tubular reactor having an internal volume of about 67 mL. The temperature of post treatment device is maintained at about 100° C. Therefore, the post treatment device has temperature gradient of between 200° C. and 100° C. through the course of flow of the first product stream. Hydrogen gas is not separately supplied to the post-treatment device. The post treatment reactor is catalyst free. The post treatment device produces a second product stream that is depressurized with a back pressure regulator to atmospheric pressure. The second product stream is then separated into gas and liquid phase. Total liquid yield of oil and water is about 100 wt %. The liquid-phase of the second product stream is separated to oil and water phases using a demulsifier and centrifuge machine. Table 1 shows representative properties of post treated final product.

TABLE 1

Properties of Feedstock and Product

| | Total Sulfur | API Gravity | Distillation, T80(° C.) |
|---|---|---|---|
| Whole Range Arabian Heavy | 2.94 wt % sulfur | 21.7 | 716 |
| Example 1 | 2.30 wt % sulfur | 23.5 | 639 |
| Example 2 | 1.74 wt % sulfur | 23.7 | 637 |
| Example 3 | 1.72 wt. % sulfur | 23.7 | 636 |

As shown in Table 1, the first process consisting of a hydrothermal reactor utilizing supercritical water results in a decrease of total sulfur of about 22% by weight. In contrast, use of the post treatment device, either with or without a catalyst, results in the removal of approximately an additional 19% by weight of the sulfur present, for an overall reduction of approximately 41% by weight. The post treatment device also results in a slight increase of the API gravity and a slight decrease of the T80 distillation temperature, as compared with supercritical hydrotreatment alone. API Gravity is defined as (141.5/specific gravity at 60° F.)−131.5. Generally, the higher the API gravity, the lighter the hydrocarbon. The T80 distillation temperature is defined as the temperature where 80% of the oil is distilled.

In certain embodiments, the post-treatment device can be operated without catalyst present. In such instances, the post-treatment acts as a heat treating device wherein the water can be superheated to induce a chemical process (known as aquathermolysis). Aquathermolysis with water is effective for the decomposition of thiols.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

That which is claimed is:

1. A method for upgrading of petroleum feedstock, comprising the steps of:

providing a pressurized and heated petroleum feedstock, wherein said petroleum feedstock is maintained at a temperature of between about 10° C. and 250° C. and a pressure of at least about 22.06 MPa;

providing a pressurized and heated water feed, wherein said water feed is maintained at a temperature of between about 250° C. and 650° C. and a pressure of at least about 22.06 MPa;

combining said pressurized and heated petroleum feedstock and said pressurized and heated water feed to form a combined petroleum and water feed stream;

supplying the combined petroleum and water feed stream to a hydrothermal reactor to produce a first product stream, wherein said reactor is maintained at a temperature of between 380° C. and 550° C., the combined petroleum and water feed stream being maintained within the hydrothermal reactor for a residence time operable to crack hydrocarbons present in the combined petroleum and water feed stream;

transferring the first product stream to a post-treatment device to produce a second product stream, wherein said post-treatment device is maintained at a temperature of between about 100° C. and 300° C., wherein water present in the post-treatment device is maintained in a liquid phase;

collecting the second product stream from the post treatment device, the second product stream comprising hydrocarbon product and water, wherein the hydrocarbon product has a reduced sulfur content relative to the petroleum feedstock.

2. The method of claim 1 further comprising the step of maintaining the hydrothermal reactor at a temperature and pressure such that the water is in a supercritical state.

3. The method of claim 1 wherein the post-treatment device further comprises a post-treatment catalyst.

4. The method of claim 3 wherein the post-treatment catalyst includes an active species selected from the group consisting of the Group VIB, and Group VIIIB elements.

5. The method of claim 3 wherein the post-treatment catalyst is a desulfurization catalyst.

6. The method of claim 3 further comprising the step of maintaining the post-treatment device at a temperature and pressure such that water is in a sub-critical state.

7. The method of claim 3 further comprising the step of maintaining the post-treatment device at a temperature of between about 120 and 200° C.

8. The method of claim 1 further comprising supplying the combined petroleum and water feed stream to the hydrothermal reactor through a transport line, wherein the residence time of the combined petroleum and water feed stream in the transport line is between about 0.1 seconds and 10 minutes.

9. The method of claim 1 wherein the upgrading of the petroleum feedstock in the hydrothermal reactor is in the absence of external hydrogen gas.

10. The method of claim 1 wherein the upgrading of the petroleum feedstock in the hydrothermal reactor is in the absence of external catalyst.

11. The method of claim 1 wherein the ratio of petroleum feed to water feed is between about 2:1 to 1:2.

12. The method of claim 1 wherein the residence time of the combined petroleum and water stream in the hydrothermal reactor is between 1 second and 120 minutes.

13. The method of claim 1 wherein the residence time of the combined petroleum and water stream in the hydrothermal reactor is between 2 minutes and 30 minutes.

14. The method of claim 1 wherein hydrogen is not supplied to the post-treatment device.

15. A method for upgrading petroleum, the method comprising the steps of:

(1) providing a heated and pressurized a petroleum feedstock;

(2) providing a water feed, wherein said water feed is in the supercritical state;

(3) combining the heated and pressurized petroleum feedstock and the supercritical water feed to produce a combined petroleum and supercritical water feed;

(4) supplying the petroleum and supercritical water combined feed to a hydrothermal reactor to produce a first product stream;

(5) supplying the first product stream to a post-treatment device to produce a second product stream, wherein said post-treatment device is maintained at a temperature of between about 100° C. and 300° C., wherein water present in the post-treatment device is maintained in a liquid phase; and (6) separating the second product stream into an upgraded petroleum stream and a water stream, wherein said upgraded petroleum stream has a reduced sulfur content relative to the petroleum feedstock.

16. The method of claim 15 wherein the hydrothermal reactor is maintained at a temperature and pressure sufficient to maintain the water in its supercritical state.

17. The method of claim 15 wherein the contact time of the petroleum feedstock and the supercritical water is between 0.1 seconds and 1 minute.

18. The method of claim 15 wherein the contact time of the petroleum feedstock and the supercritical water is between 0.5 seconds and 10 seconds.

19. The method of claim 15 wherein the hydrothermal reactor is maintained at a temperature greater than about 400°.

20. The method of claim 15 wherein hydrogen is not supplied to the post-treatment device.

21. A method for upgrading a petroleum feedstock, comprising the steps of:

providing a petroleum feedstock and water mixture to a reaction zone, wherein said reaction zone is maintained at a temperature and pressure that is greater than about the supercritical point of water, and said reaction zone does not include externally supplied hydrogen;

allowing the petroleum feed and the supercritical water to contact in the reaction zone for a first reaction time to produce a first reactor product stream, wherein the reaction time is operable to upgrade at least a portion of the petroleum feedstock;

supplying the first reactor product stream to a second reactor and contacting the first reactor product stream with a hydrocarbon upgrading catalyst to produce a second reactor product stream that includes upgraded hydrocarbons, wherein the second reactor is maintained at a temperature below 300° C. and pressure that is less than the critical pressure of water, wherein water present in the post-treatment device is maintained in a liquid phase, and wherein the reaction product and catalyst are contacted for a second reaction time that is sufficient to remove at least a portion of sulfur containing compounds present reaction product; and separating the second reactor product stream into an upgraded hydrocarbon product stream and a water stream.

* * * * *